United States Patent [19]

Marsocci

[11] 4,232,307

[45] Nov. 4, 1980

[54] ELECTRICAL TEST CIRCUIT FOR OPTICAL PARTICLE DETECTOR

[75] Inventor: Angelo A. Marsocci, Duxbury, Mass.

[73] Assignee: American District Telegraph Company, Jersey City, N.J.

[21] Appl. No.: 970,620

[22] Filed: Dec. 18, 1978

[51] Int. Cl.[3] ..... G08B 21/00; G08B 17/10

[52] U.S. Cl. ..... 340/515; 250/574; 340/630; 356/439; 356/343

[58] Field of Search ..... 340/514, 515, 516, 628, 340/629, 630; 250/564, 565, 574, 552, 553, 573; 356/438, 439, 343

[56] References Cited

U.S. PATENT DOCUMENTS 2,839,741 6/1958 Kratville ..... 340/514

FOREIGN PATENT DOCUMENTS 919640 2/1963 United Kingdom ..... 250/565

*Primary Examiner*—John W. Caldwell, Sr.
*Assistant Examiner*—Daniel Myer
*Attorney, Agent, or Firm*—James H. Grover

[57] ABSTRACT

A photoelectronic smoke detector has walls around a dark chamber to which smoke, but not light, is admitted, and through which light is directed from an exciter light source on a path to a limited area of a chamber wall. A first photocell views light scattered from the through path by particles in the path primarily to produce an alarm signal, and also receives background light scattered from the chamber wall outside the limited area. A second photocell is disposed to receive background light substantially only from the limited area and other areas outside the source light path. The first cell produces a first signal in response to background and particle-scattered light. The second cell produces a second signal corresponding to background scatter. The first and second cells, preferably photovoltaic photodiodes, are coupled in opposition in a circuit whose output consequently is substantially independent of the background light. A remotely operated test relay or similar switching means has contacts which switch the second photovoltaic diode from a connection in which it opposes the signal of the first photocell as just described to a connection in which it reinforces the first photocell signal thereby to raise the joint photocell output to alarm level in the absence of particles and test operation of the light source, first photocell and subsequent alarm circuits.

4 Claims, 5 Drawing Figures

ELECTRICAL TEST CIRCUIT FOR OPTICAL PARTICLE DETECTOR

RELATED APPLICATION

Reference is made to application Ser. No. 885,369 of Glenn F. Cooper entitled OPTICLE PARTICLE, filed Mar. 13, 1978.

BACKGROUND OF THE INVENTION

Known optical smoke and other particle detectors comprise a source whose light is directed on a path or beam which may be interrupted by smoke or other particles or media which scatter light from the directed path to a sensing photocell, the photocell responding to the scattered light by producing an electrical signal.

It is also well known to compensate for variations in the light source by employing a second photocell exposed to light direct from the source and connected in a circuit with the first photocell so that the response of the second cell to undesired light source variations cancels the effect of such variations on the first, smoke sensing, cell as disclosed for example in U.S. Pat. Nos. 2,301,367 and 3,409,885.

The object of the previous application Ser. No. 885,369 referred to above, however, is to employ a second photocell in a way distinctly different from that described above in that the second cell is not exposed to light directly from the source, but rather the second cell is disposed so that it compensates not for light source variations, but instead compensates for the background light conditions in the dark chamber of a smoke detector, for example. These light background conditions are meant to include outside ambient light leaking into the chamber and such internal source light as is scattered from dark chamber walls outside the directed path from the source. The background light condition affects the total response of the smoke sensing photocell unduly when the background light sensed approaches the energy of the light scattered by smoke from the light beam or path. That is, the background light tends to mask the smoke scattered light and reduce the sensitivity of the detector to very low densities of smoke which occur early in a fire. The circuit of the previous application thus acts to increase the sensitivity of a particle detector to small changes in particle density, to permit reduction in the source light intensity, and to compensate for increase in background scattered light as dust and the like accumulate on the walls of the dark chamber.

The purpose of the present invention is to retain the advantages of background light compensation of the previous application and additionally provide a way of testing the fitness for operation of the particle detector. One known particle detector test arrangement incorporates a flag or the like mechanically moved into the exciter light path to simulate particles. Such a mechanical test system involves additional parts and assembly expense which though not great is an economic factor. Another arrangement involves an additional light source simulating light scattered by particles. The main disadvantage with the other arrangement is that it will simulate particles when the primary exciter light is out and the particle detector is actually inoperative.

Accordingly, one object of the present invention is to utilize the second photocell both to compensate for background light and to test operativeness of the particle detector thus also eliminating the need for additional mechanical parts or light. A further object is to provide a test which will indicate inoperativeness of the primary exciter light source. A still further object is to make it possible to electrically test operativeness from a location remote from the particle detector.

STATEMENT OF INVENTION

According to the invention an optical particle detector comprises wall means forming a chamber, means for directing light on a path through the chamber, a first photocell disposed to respond primarily to light scattered by particles in the light path to produce an alarm signal, a second photocell responsive to light from outside the path, and means coupling the photocells to a common signal output including test means for switching the second photocell from reduction to reinforcement of the first photocell signal thereby to raise photocell output to alarm level.

Further according to the invention the second photocell is disposed to respond substantially to background light scattered from outside the through light path.

Describing the disposition of the second cell to respond to scattered light from outside the source light through path distinguishes clearly from the previously known disposition of a second cell in a path optically direct from the source. The expression "through light path" describes the source light path through the air space of the chamber whence it can be scattered by particles, as compared to the limited wall area where the light path is incident on the dark chamber wall and whence background light is scattered.

DRAWING

DESCRIPTION

Figure 1:
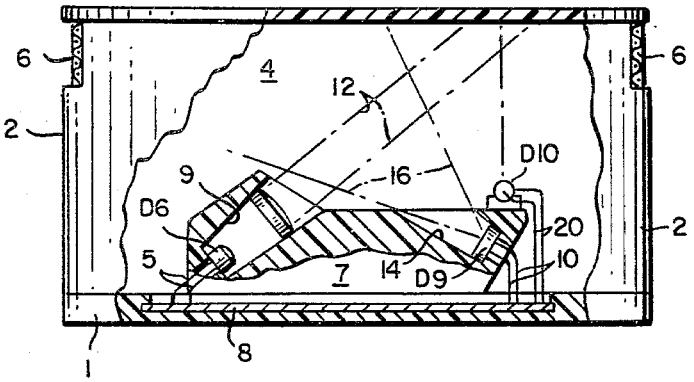
FIG. 1 is an elevation, partly broken away, of a smoke detector according to the invention.
Figure 3:
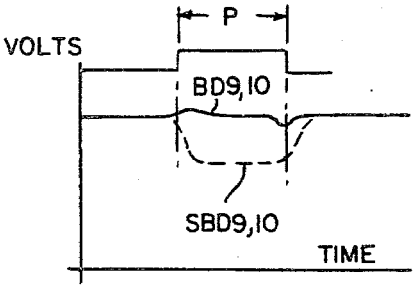

One form of optical smoke-detector according to the invention has an external housing shown diagrammatically in FIG. 1 as including a base 1, a circular sidewall 2 and a cover wall 3 enclosing a dark chamber 4 to which smoke has access through a porous foam sheet 6 (U.S. Pat. No. 3,947,303) or other labyrinthine structure which excludes light and insects. Adjacent the dark chamber is a chambered block 7 mounting the optical elements of the detector. Below the optical block is a circuit board 8 carrying the circuit components of the detector as shown in FIG. 3, except for the components in the optical block 7.

At one end of a light passage 9 in the optical block 7 is an infrared light emitting diode D6, for example RCA LED type SG 101A, with leads 5 to the circuit board 8. A lens 11 directs about 98% of the light from this source on a narrow path 12 through the air space within the chamber striking a limited area 13 of the housing wall 3 beyond the through path. The remaining 2% of source light is generally scattered throughout the dark chamber as is light incident on the limited area 13, the two constituting background light.

At the end of a second passage 14 oriented at 120° to the light passage 9 is a smoke sensing photodiode D9, Clairex Corporation type CLD56-1, a photovoltaic form of photocell with leads 10 to the circuit board. This photodiode D9 is primarily disposed to view the free path of light from the LED source D6 and respond to light scattered from smoke particles in the path within the view 16 of the photodiode D9. The smoke sensing diode D9 though shielded by the optical block 7 from light scattered directly from the limited area 13 beyond the through path 12 of the source light, LED D9, inevitably receives light scattered from that area 13 and from other areas of the side wall 2, the cover wall 3 and the optical block 7 including the second passage 14.

Although the undesired wall-scattered light is very low in intensity, so also is the smoke scattered light. Current national standards of smoke detector sensitivity require the detection of grey smoke which obscures 1.5% of the light through one foot. Such a smoke density will scatter somewhat less than 1.5% of the source light in all directions, and a considerably lower percentage will reach the smoke sensing cell D9.

Figure 2:
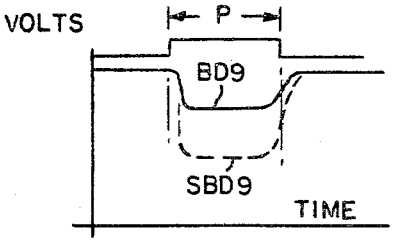
FIGS. 2 and 3 are time versus voltage graphs showing comparative signal voltages in the circuit of FIG. 3.

Shown somewhat idealized in FIG. 2 is a typical proportion between response to background light and smoke-plus-background light prior to the present inventions. As is explained with reference to FIG. 4, the LED source D6 is lighted for a pulse interval P. During this interval the relative voltage response of the smoke cell D9 in the absence of smoke is shown in FIG. 3 by the solid line curve BD9. In the presence of smoke-plus-background the relative voltage response is shown by the broken line curve SBD9. The proportion of background response BD9 to smoke-plus-background response SBD9 of the smoke sensing diode D9 varies with the intensity of light source and the configuration and optical characteristics of the dark chamber walls. But FIG. 2 fairly represents that, in the absence of compensation according to the present invention, the continuous response BD9 of the smoke cell 9 to background light is a substantial proportion of response SBD9 of the same cell to smoke scattered light and background light. That is the sensitivity of the cell is greatly reduced by its high response to background light. The loss of sensitivity illustrated by FIG. 2 can be largely overcome as shown in FIGS. 1, 3 and 4.

In FIG. 1 a second photovoltaic diode D10 is shown mounted on the top of the optical block 7 with leads 20 extending to the circuit board 8. The photodiode D10 is a plastic body diode, type 1N4001, a different, considerably less sensitive type than the smoke sensing diode D9 since it is exposed to the brightly illuminated limited area 13 beyond the through path 12 from the source light D6.

Figure 4:
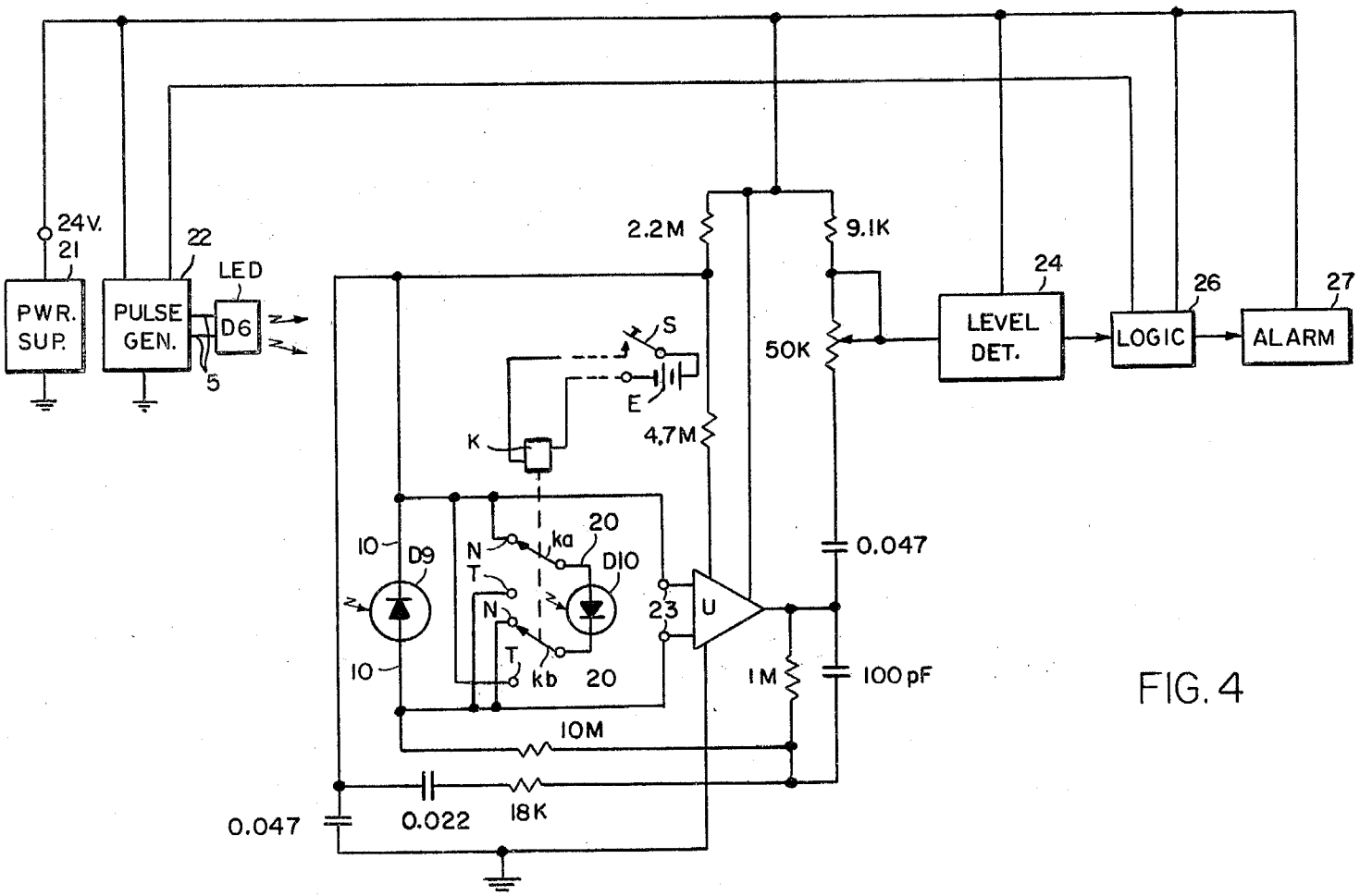
FIG. 4 is a schematic diagram of a circuit for the detectors of FIGS. 1 and 2.

As shown in FIG. 4, the first and second diodes D9 and D10 are connected to each other and to their output 23 (which is also the input to an operational amplifier U type CA 3078S for example) by the ganged contacts ka and kb of a relay K. As shown the relay coil is energized by a switch S and voltage source E located remotely from the smoke detector. An electronic relay would be as suitable as the electromagnetic relay shown, and a local manual switch or magnetic reed switch could be used to accomplish the function of contacts ka and kb.

Each of the contacts ka and kb has a normal position N as shown and a test position T. In the normal position N the second photovoltaic diode D10 is connected in opposition to the first photodiode D9 and reduces the first photodiode signal in proportion to background light. That is, the anode of each photodiode is coupled either directly as shown, or indirectly to the cathode of the other diode. In FIG. 4 a 24 volt direct current power supply 21 energizes a pulse generator 22, which in turn flashes the LED light source D6 for about 150 microseconds pulse duration P at 2.5 second intervals, for example. The diodes D9 and D10 are thus pulsed with background light and also with scattered light if smoke is present. By virtue of the kinds of light to which they are exposed and of their coupling in opposition their voltages at the amplifier input 23 take the form shown idealized in FIG. 3. In the no-smoke condition the solid line voltage BD9, 10 resultant from the coupled responses of the photocells D9 and D10 to the background light during the light pulse P is now substantially level at the applied voltage from the power supply 21, with insignificant deviations at the beginning and end of the pulse P duration. In the presence of smoke the broken line voltage SBD9, 10 resultant from the coupled responses of both photocells D9, 10 to smoke scattered and background light is much like the single cell response SBD9 of FIG. 2. But the ratio between the no-smoke and smoke response is much greater because the solid line no-smoke response BD9,10 is inconsiderable relative to the broken line smoke response SBD9, 10. Consequently very low densities of smoke, e.g. under 1% obscuration per foot, can be detected sensitively and accurately at lowered light output, hence lower power consumption by the LED source D6.

The coupled, difference voltage smoke signal is amplified by the operational amplifier U whose associated resistive and circuit components have values indicated in a conventional way. The amplified output of the operational amplifier is applied through a 50 kilohm potentiometer to a level detector 24 whose threshold is set by the potentiometer to correspond to a predetermined smoke density. When the level detector's threshold is exceeded by the amplifier output the level detector applies a pulse of data to a logic circuit 26 simultaneously with a clock pulse from the pulse generator 22. The logic circuit then triggers a smoke alarm 27 which may be a local visible or audible alarm or a relay to a remote alarm device.

Figure 5:
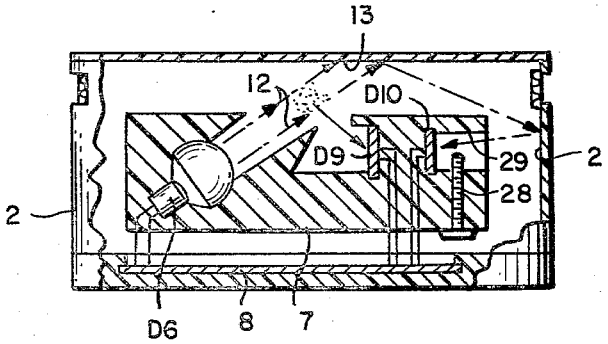
FIG. 5 is a similar elevation of a second form of the invention.

FIG. 5 shows a smoke detector with components and voltages like those of FIG. 1, but differing in that a second photodiode D10 is of the same order of sensitivity as the first photodiode D9, the second diode is shielded from light scattered from the through path 12 and the shield is in the form of an adjustable screw 28 varying light reaching the second diode through a passage 29 in the optical block 8. The second photodiode of FIG. 5 also receives light more indirectly scattered from the housing wall 3 and the sidewall 2 than in the case of FIG. 1.

The detectors of FIG. 5 and FIG. 1 both provide the advantage of significantly greater sensitivity to the very slight changes from zero to less than 1% smoke obscuration per foot. Greater background light can be tolerated than hitherto, and the size of the dark chamber and hence the ouside dimension of the detector can be reduced without sacrifice of reliability. The LED light source power requirement can be reduced while the sensitivity of the smoke sensing cell D9 to variation in LED current and efficiency is minimized. During the life of the detector extended over many years, increase in background light scattering due to accumulation of dust on the dark chamber walls is compensated by the location of the second cell so as to view light primarily from outside the through path of source light, and the coupling of the first and second cells in opposition in the amplifying circuit.

The present invention should be understood in connection with the foregoing description of the background light compensation circuit with the contacts ka and kb in the normal position N as shown in FIG. 4.

According to the present invention when the contacts ka and kb are transferred to the test position T, the second photodiode is reversed in polarity with respect to the first photodiode and the photocell output 23, and the second photocell reinforces the first photocell signal instead of opposing it. As a consequence the reinforcing output of both photocells D9 and D10 will increase from the neutral level BD9,10 of FIG. 3 to a test level exceeding the smoke and background level SBD9 of the first photocell D9 in FIG. 2. The combined, reinforcing signals of both photocells D9 and D10 are sufficient to exceed the threshold of the level detector 24 and produce an alarm signal as in the presence of a predetermined density of smoke. The operation of several portions of the particle detector is thus tested, purely electrically, with the following advantages.

The present electrical test circuit utilizes the inexpensive, existing second photocell D10 for a second function in addition to its background compensating function. The circuit tests operativeness of the exciter light D6, of the first photocell D10 and of the circuits subsequent, such as the level detector 24 and logic circuit 26 to assure they have not become degraded in sensitivity. The electrical test omits mechanically moving parts such as flags, and affords testing from remote locations. Moreover the test will be substantially more accurate than previously because the photocells respond electrically more reliably than flags or auxiliary light sources.

It should be understood that the present disclosure is for the purpose of illustration only and that this invention includes all modifications and equivalents which fall within the scope of the appended claims.

I claim:

1. An optical particle detector comprising:

wall means forming a chamber, means for directing light on a path through the chamber, a first photovoltaic cell optically disposed to respond primarily to light scattered by a predetermined density of particles in the light path to produce an alarm level signal, a second photovoltaic cell optically disposed to respond to light from outside the path, an alarm output connected to the first photovoltaic cell in a predetermined polarity, and switching means having a first position including connections from the second photovoltaic cell to the alarm output in a first polarity opposing the signal from the first cell, and including a second position including connections from the second cell to the alarm output in the reverse of the first polarity thereby to reinforce and raise the level of the signal of the first cell at the output in the second position to alarm level so as to indicate operativeness of the light directing means and first cell.

2. A detector according to claim 1 wherein the switching means comprises a relay having energizing terminals for connection to a remote test switch.

3. A detector according to claim 1 wherein the cells are disposed with respect to the light directing means to respond with signals of the same order of amplitude.

4. A detector according to claim 1 wherein the second cell is disposed to respond substantially to background light scattered from outside the through light path.

* * * * *